US006583775B1

(12) United States Patent
Sekiya et al.

(10) Patent No.: US 6,583,775 B1
(45) Date of Patent: Jun. 24, 2003

(54) IMAGE DISPLAY APPARATUS

(75) Inventors: Mitsunobu Sekiya, Tokyo (JP); Akira Yumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 212 days.

(21) Appl. No.: 09/594,087

(22) Filed: Jun. 15, 2000

(30) Foreign Application Priority Data

Jun. 17, 1999 (JP) ..... 11-170577
Jun. 2, 2000 (JP) ..... 2000-166170

(51) Int. Cl.[7] ..... G09G 3/30
(52) U.S. Cl. ..... 345/76; 345/77; 345/82
(58) Field of Search ..... 345/92, 87, 76, 345/77, 80, 82, 55; 315/169.4, 169.3, 169.1; 340/815.45

(56) References Cited

U.S. PATENT DOCUMENTS 5,198,803 A * 3/1993 Shie et al. ..... 340/782
5,952,789 A 9/1999 Stewart et al. ..... 315/169.4
6,229,506 B1 * 5/2001 Dawson et al. ..... 345/82
6,229,508 B1 * 5/2001 Kane ..... 345/82

FOREIGN PATENT DOCUMENTS

EP 0 905 673 3/1999
JP 10-319908 12/1998
WO 98/33165 7/1998

* cited by examiner

*Primary Examiner*—Dennis-Doon Chow

(57) ABSTRACT

The invention provides an image display apparatus which increases the degree of freedom in designing of an active element of a pixel to allow good designing and can adjust the display brightness freely and simply. Each pixel includes a light emitting element (OLED) with a brightness value which varies depending upon an amount of current supplied thereto, a first TFT controlled by a scanning line for writing brightness information given thereto from a data line into the pixel, and a second TFT for controlling the amount of current to be supplied to the OLED corresponding to the brightness information written. Writing of the brightness information into each pixel is performed by applying an electric signal corresponding to the brightness information to the data line while the scanning line is selected. The brightness information written in each pixel is held by the pixel also after the scanning line is placed into a non-selected state so that the OLED can continue lighting with a brightness value corresponding to the brightness information held by the pixel. A stopping control line compulsorily extinguishes the OLEDs of the pixels connected to the same scanning line at least in a unit of a scanning line so that the OLEDs are placed into an extinguished state from a lit state within a period of one scanning cycle after the brightness information is written into the pixels until new brightness information is written into the pixels subsequently.

26 Claims, 12 Drawing Sheets

IMAGE DISPLAY APPARATUS

BACKGROUND OF THE INVENTION

This invention relates to an image display apparatus which includes a pixel whose brightness is controlled with a signal, and more particularly to an image display apparatus which includes, for each pixel, a light emitting element for emitting light with brightness which is controlled with current such as an organic electroluminescence (EL) element. More specifically, the present invention relates to an image display apparatus of the active matrix type wherein the amount of current to be supplied to a light emitting element is controlled by an active element such as a field effect transistor of the insulated gate type provided in each pixel.

Generally, in an image display apparatus of the active matrix type, a large number of pixels are arranged in a matrix, and the intensity of light is controlled for each of the pixels in response to brightness information given thereto to display an image. Where liquid crystal is used as an electro-optical substance, the transmission factor of each pixel varies in response to a voltage written in the pixel. Even with an image display apparatus of the active matrix type which employs an organic electroluminescence material as an electro-optical substance, basic operation is similar to that where liquid crystal is employed. However, different from a liquid crystal display apparatus, an organic EL display apparatus is an apparatus of the self light emission type wherein each pixel has a light emitting element. Thus, the organic EL display apparatus is advantageous in that it exhibits a higher degree of visibility than a liquid crystal display apparatus, that it does not require a back light and that it has a higher responding speed. The brightness of each individual light emitting element is controlled with the amount of current. In other words, the organic EL display is significantly different from the liquid crystal display apparatus and so forth in that the light emitting elements are of the current driven type or the current controlled type.

Similarly to the liquid crystal display apparatus, the organic EL display apparatus can possibly use a simple matrix system or an active matrix system as a driving system therefor. Although the former is simple in structure, it is difficult to implement a display apparatus of a large size and a high resolution. Therefore, much effort has been and is directed to development of organic EL display apparatus of the active matrix system. In the organic EL display apparatus of the active matrix system, current to flow to a light emitting element provided in each pixel is controlled by an active element usually in the form of a thin film transistor which is a kind of a field effect transistor of the insulated gate type and may be hereinafter referred to as TFT. An organic EL display apparatus of the active matrix system is disclosed, for example, in Japanese Patent Laid-open No. Hei 8-234683, and an equivalent circuit for one pixel in the organic EL display apparatus is shown in FIG. 10. Referring to FIG. 10, the pixel PXL shown includes a light emitting element OLED, a first thin film transistor TFT1, a second thin film transistor TFT2, and a holding capacitor Cs. The light emitting element OLED is an organic electroluminescence (EL) element. Since an organic EL element in most cases has a rectification property, it is often called OLED (organic light emitting diode) and, in FIG. 10, the mark of a diode is used for the light emitting element OLED. However, the light emitting element is not limited to an OLED, but may be any element only if the brightness thereof is controlled with the amount of current to flow therethrough. It is not always required for an OLED to have a rectification property. In the pixel shown in FIG. 10, a reference potential (ground potential) is applied to the source S of the second thin film transistor TFT2, and the anode A (positive electrode) of the light emitting element OLED is connected to a power supply potential Vdd while the cathode K (negative electrode) is connected to the drain D of the second thin film transistor TFT2. Meanwhile, the gate G of the first thin film transistor TFT1 is connected to a scanning line X and the source S of the first thin film transistor TFT1 is connected to a data line Y. The drain D of the first thin film transistor TFT1 is connected to the holding capacitor Cs and the gate G of the second thin film transistor TFT2.

In order to cause the pixel PXL to operate, the scanning line X is placed into a selected state first, and then a data potential Vdata representative of brightness information is applied to the data line Y. Consequently, the first thin film transistor TFT1 is rendered conducting, and the holding capacitor Cs is charged or discharged and the gate potential of the second thin film transistor TFT2 becomes equal to the data potential Vdata. Then, if the scanning line X is placed into a non-selected state, then the first thin film transistor TFT1 is turned off, and the second thin film transistor TFT2 is electrically disconnected from the data line Y. However, the gate potential of the second thin film transistor TFT2 is held stably by the holding capacitor Cs. The current flowing to the light emitting element OLED through the second thin film transistor TFT2 exhibits a value which depends upon a gate-source voltage Vgs of the second thin film transistor TFT2, and the light emitting element OLED continues to emit light with a brightness value corresponding to the amount of current supplied from the second thin film transistor TFT2.

In the present specification, the operation of selecting a scanning line X to transmit a potential of a data line Y to the inside of a pixel is hereinafter referred to as "write". Where the current flowing between the drain and the source of the second thin film transistor TFT2 is represented by Ids, this is driving current flowing to the light emitting element OLED. If it is assumed that the second thin film transistor TFT2 operates in a saturation region, then the current Ids is represented by the following expression:

$$Ids = (1/2)\cdot\mu\cdot Cox\cdot(W/L)\cdot(Vgs - Vth)^2 \quad (1)$$

$$= (1/2)\cdot\mu\cdot Cox\cdot(W/L)\cdot(Vdata - Vth)^2$$

where Cox is a gate capacitance per unit area and is given by the following expression:

$$Cox = \epsilon 0\cdot\epsilon r/d \quad (2)$$

In the expressions (1) and (2) above, Vth is a threshold voltage for the second thin film transistor TFT2, $\mu$ is the mobility of carriers, W is the channel width, L is the channel length, $\epsilon$ 0 is the dielectric constant of vacuum, $\epsilon$ r is the dielectric constant of the gate insulating film, and d is the thickness of the gate insulating film.

According to the expression (1), the current Ids can be controlled with the data potential Vdata to be written into the pixel PXL, and as a result, the brightness of the light emitting element OLED can be controlled. Here, the reason why the second thin film transistor TFT2 operates in a saturation region is such as follows. In particular, the reason is that, since, in a saturation region, the current Ids is controlled only with the gate-source voltage Vgs but does not rely upon the drain-source voltage Vds, even if the drain-source voltage Vds is fluctuated by a dispersion in characteristic of the light emitting element OLED, a predetermined amount of current Ids can be flowed to the light emitting element OLED.

As described hereinabove, with the circuit construction of the pixel PXL shown in FIG. 10, if writing of the data potential Vdata is performed once, then the light emitting element OLED continues to emit light with a fixed brightness value for a period of one scanning cycle (one frame) until it is rewritten. If a large number of such pixels PXL are arranged in a matrix as shown in FIG. 11, then an image display apparatus of the active matrix type can be constructed. As seen from FIG. 11, a conventional image display apparatus includes a plurality of scanning lines X1 to XN for selecting pixels PXL in a predetermined scanning cycle (for example, in a frame period complying with the NTSC standards), and a plurality of data lines Y for providing brightness information (data potentials Vdata) for driving the pixels PXL. The scanning lines X1 to XN and the data lines Y extend perpendicularly to each other such that the pixels PXL may be arranged in a matrix at intersecting points thereof. The scanning lines X1 to XN are connected to a scanning line drive circuit 21, and the data lines Y are connected to a data line drive circuit 22. The scanning lines X1 to XN are successively selected by the scanning line drive circuit 21 while writing of the data potentials Vdata is repeated successively from the data lines Y by the data line drive circuit 22 thereby to display a desired image. While, in an image display apparatus of the simple matrix type, the light emitting element included in each pixel PXL emits light only at a selected instant, the image display apparatus of the active matrix type shown in FIG. 11 is advantageous in that, since the light emitting element of each pixel PXL continues its light emission also after writing into it is completed, the peak brightness (peak current) of the light emitting elements can be decreased when compared with that of the image display apparatus of the simple matrix type, particularly where the display device has a large size and a high resolution.

FIG. 12 is an equivalent circuit diagram showing another conventional pixel structure. In FIG. 12, elements corresponding to those of the conventional pixel structure shown in FIG. 10 are denoted by like reference characters to facilitate understanding. While the conventional pixel structure of FIG. 10 uses a field effect transistor of the N-channel type for the thin film transistors TFT1 and TFT2, the conventional pixel structure of FIG. 12 uses a field effect transistor of the P-channel type. Accordingly, in the pixel structure of FIG. 12, the cathode K of the light emitting element OLED is connected to the negative power supply potential Vdd and the anode A is connected to the drain D of the second thin film transistor TFT2 conversely to those in the pixel structure of FIG. 10.

FIG. 13 is a cross sectional view schematically showing a sectional structure of the pixel PXL shown in FIG. 12. However, in order to facilitate illustration, only the light emitting element OLED and the second thin film transistor TFT2 are shown in FIG. 13. The light emitting element OLED includes a transparent electrode 10, an organic EL layer 11 and a metal electrode 12 placed one on another in this order. The transparent electrode 10 is provided separately for each pixel and functions as the anode A of the light emitting element OLED, and is formed from a transparent conductive film of, for example, ITO. The metal electrode 12 is connected commonly among the pixels and functions as the cathode K of the light emitting element OLED. In particular, the metal electrodes 12 are connected commonly to a predetermined power supply potential Vdd. The organic EL layer 11 is a composite film including, for example, a positive hole transporting layer and an electron transporting layer. For example, Diamyne is vapor deposited as the positive hole transporting layer on the transparent electrode 10 which functions as the anode A (positive hole injecting electrode) and Alq3 is vapor deposited as the electron transporting layer on the positive hole transporting layer, and then the metal electrode 12 which functions as the cathode K (electron injecting electrode) is formed on the electron transporting layer. It is to be noted that Alq3 represents 8-hydroxy quinoline aluminum. The light emitting element OLED having such a layered structure as just described is a mere example at all. If a forward voltage (approximately 10 V) is applied between the anode and the cathode of the light emitting element OLED having such a structure as described above, then injection of carriers such as electrons and positive holes occurs, and emission of light is observed. The operation of the light emitting element OLED is considered to be emission of light by excited elements formed from positive holes injected from the positive hole transporting layer and electrons injected from the electron transporting layer.

Meanwhile, the second thin film transistor TFT2 includes a gate electrode 2 formed on a substrate 1 made of glass or the like, a gate insulating film 3 placed on the upper face of the gate electrode 2, and a semiconductor thin film 4 placed on the gate electrode 2 with the gate insulating film 3 interposed therebetween. The semiconductor thin film 4 is formed from, for example, a polycrystalline silicon thin film. The second thin film transistor TFT2 includes a source S, a channel Ch and a drain D which form a path for current to be supplied to the light emitting element OLED. The channel Ch is positioned immediately above the gate electrode 2, and the second thin film transistor TFT2 of the bottom gate structure is covered with an interlayer insulating film 5, and a source electrode 6 and a drain electrode 7 are formed on the interlayer insulating film 5. The light emitting element OLED described above is formed on the elements mentioned above with another interlayer insulating film 9 interposed therebetween.

The first subject to be solved when such an EL display apparatus of the active matrix type as described above is to be formed is that the degree of freedom in designing the second thin film transistor TFT2 which is an active element for controlling the amount of current to flow through the light emitting element OLED is low and, under certain circumstances, practical designing suitable for pixel dimensions is difficult. The second subject to be solved is that it is difficult to freely adjust the display brightness of the entire screen. The subjects described are described giving specific design parameters with regard to the conventional apparatus described above with reference to FIGS. 10 to 13. In a typical design example, the screen size is 20 cm×20 cm, the number of rows (scanning line number) 1,000, the number of columns (data line number) 1,000, the pixel size S=200 $\mu$m×200 $\mu$m, the peak brightness Bp=200 cd/m$^2$, the efficiency of the light emitting element E=10 cd/A, the thickness of the gate insulating film of the second thin film transistor TFT2 d=100 nm, the dielectric constant of the gate insulating film $\epsilon$ r=3.9, the carrier mobility $\mu$=100 cm$^2$/V·S, the peak current per pixel Ip=Bp/E×S=0.8 $\mu$A, the peak value of |Vgs−Vth| (driving voltage) Vp=5 V. In order to supply the peak current Ip in the design example above, as a design example of the second thin film transistor TFT2, the channel width and the channel length are determined from the expressions (1) and (2) given hereinabove as follows:

$$\text{Channel width: } W = 5\ \mu\text{m} \tag{3}$$

$$\text{Channel length: } L = \{W/(2\cdot Ip)\}\cdot\mu\cdot Cox\cdot Vp^2 = 270\ \mu\text{m}$$

Here, it is the first problem that the channel length L given by the expression (3) above is equal to or greater than the pixel size (S=200 $\mu$m×200 $\mu$m). As seen from the expression (3), the peak current Ip increases in inverse proportion to the channel length L. In the example described above, in order to suppress the peak current Ip to approximately 0.8 $\mu$A which is sufficient for operation, the channel length L must be set long to 270 $\mu$m. However, this is not preferable because it requires a large occupied area of the TFT2 in the pixel, resulting in reduction of the light emitting area. Besides, refinement of pixels becomes difficult. The essential problem resides in that, if a brightness value (peak current) required and parameters of a semiconductor process and so forth are given, then there is little degree of freedom in designing of the second thin film transistor TFT2. In particular, a possible idea for reducing the channel length L in the example described above is to reduce the channel width w as can be seen apparently from the expression (3). However, there is a limitation to refinement of the channel width W in terms of the process, and it is difficult to refine the channel width W significantly with respect to the degree described above in a thin film transistor process at present. It is another possible idea to reduce the peak value Vp of the driving voltage. In this instance, however, in order to perform gradation control, it is necessary to control the intensity of light to be emitted from the light emitting element OLED with a very small driving voltage step. For example, also in the case of the peak value Vp=5 V, if it is tried to control the intensity of light to be emitted with 64 gradations, then the voltage step per one gradation is approximately 5 V/64=80 mV in average. If the voltage step is further reduced, then the display quality of the image display is influenced by fine noise or a dispersion of the TFT character. Accordingly, there is a limitation also to reduction of the peak value Vp of the driving voltage. Another possible solution is to set process parameters such as the carrier mobility $\mu$ appearing in the expression (3) to suitable values. However, it is generally difficult to control process parameters to preferable values with a high degree of accuracy, and economically, it is quite unrealistic to construct a production process in accordance with specifications of an image display apparatus to be designed at all. In this manner, in a conventional EL display apparatus of the active matrix type, the degree of freedom in designing of a pixel is so low that it is difficult to perform practical designing.

In relation to the first problem described above, it is a second problem that, in an EL display apparatus of the active matrix type, it is difficult to arbitrarily control the display brightness of the entire screen. Generally, in an image display apparatus of a television set or the like, it is an essential requirement for practical use that the display brightness of the entire screen can be adjusted freely. For example, it is natural to set the screen brightness high when the image display apparatus is used in a light situation, but suppress the screen brightness low conversely when the image display apparatus is used in a dark situation. Such adjustment of the screen brightness can be realized readily by, for example, with a liquid crystal display, varying the power of the backlight. On the other hand, with an EL display apparatus of the simple matrix type, the screen brightness can be adjusted comparatively simply by adjusting the driving current upon addressing.

However, with an organic display apparatus of the active matrix type, it is difficult to arbitrarily adjust the display brightness of the entire screen. As described above, the display brightness increases in proportion to the peak current Ip, and the peak current Ip increases in inverse proportion to the channel length L of the TFT2. Accordingly, in order to lower the display brightness, the channel length L should be increased. This, however, cannot be employed as a countermeasure for selecting the display brightness arbitrarily by a user. A method which seems possible to realize is to reduce the peak value Vp of the driving voltage in order to reduce the brightness. However, if the peak value Vp is reduced, then deterioration of the picture quality is caused by noise or the like. On the contrary where it is desired to raise the brightness, even if it is tried to raise the peak value Vp of the driving voltage, it is a matter of course that there is an upper limitation to it because of a voltage withstanding property of the second thin film transistor TFT2 and so forth.

SUMMARY OF THE INVENTION

It is an object of the present invention to provide an image display apparatus which increases the degree of freedom in designing of an active element in the inside of a pixel to allow good designing and can adjust the screen brightness freely and simply.

In order to attain the object described above, according to a first aspect of the present invention, there is provided an image display apparatus, comprising a plurality of pixels arranged in a matrix, a plurality of scanning lines for selecting the pixels in a predetermined scanning cycle, a plurality of data lines extending perpendicularly to the scanning lines for providing brightness information to drive the pixels, the pixels being disposed at intersecting points of the scanning lines and the data lines, each of the pixels including a light emitting element for emitting light with a brightness value which varies depending upon an amount of current supplied thereto, a first active element controlled by one of the scanning lines for writing the brightness information given thereto from one of the data lines into the pixel, and a second active element for controlling the amount of current to be supplied to the light emitting element in response to the brightness information written in the pixel, writing of the brightness information into each of the pixels being performed by applying an electric signal corresponding to the brightness information to the data line connected to the pixel while the scanning line connected to the pixel is selected, the brightness information written in each of the pixels being held by the pixel also after the scanning line connected to the pixel is placed into a non-selected state so that the light emitting element of the pixel can continue lighting with a brightness value corresponding to the brightness information held by the pixel, and control means for compulsorily extinguishing the light emitting elements of those of the pixels which are connected to a same one of the scanning lines at least in a unit of a scanning line so that the light emitting elements are placed into an extinguished state from a lit state within a period of one scanning cycle after the brightness information is written into the pixels until new brightness information is written into the pixels subsequently.

Preferably, the control means is capable of adjusting a point of time at which each of the light emitting elements is changed over from a lit state to an extinguished state within a period of one scanning cycle after the brightness information is written into the pixels until new brightness information is written into the pixels subsequently.

The image display apparatus may be constructed such that the control means includes a third active element connected to a gate of the second active element, which is in the form of a field effect transistor of the insulated gate type, of each of the pixels and is capable of providing a control signal to the third active element to control a gate potential of the second active element thereby to extinguish the light emitting element of the pixel, the control signal being applied to the third active elements included in those of the pixels which are on a same one of the scanning lines over a stopping control line provided for and in parallel to each of the scanning lines.

As an alternative, the image display apparatus may be constructed such that the control means includes a third active element connected in series to the light emitting element of each of the pixels and is capable of providing a control signal to the third active element to cut off current to flow to the light emitting element, the control signal being applied to the third active elements included in those of the pixels which are on a same one of the scanning lines over a stopping control line provided for and in parallel to each of the scanning lines.

Otherwise, the image display apparatus may be constructed such that the light emitting element of each of the pixels includes a two-terminal element having a rectification function and having a first terminal connected to the second active element and a second terminal connected to the second terminals of those of the pixels which are connected to a same one of the scanning lines to which the pixel is connected but electrically isolated from the second terminals of those of the pixels which are connected to any other one of the scanning lines, and the control means controls a potential of the second terminals of the two-terminal elements which are connected commonly to the same scanning line to extinguish the two-terminal elements.

The control means may select, within a period of one scanning cycle after the brightness information is written into the pixels until new brightness information is written into the pixels subsequently, the scanning lines again to write information representative of brightness of zero into the pixels from the data lines to extinguish the light emitting elements of the pixels.

The image display apparatus may be constructed otherwise such that each of the pixels further includes a capacitive element having an end connected to a gate of a field effect transistor of the insulated gate type which forms the second active element for controlling the amount of current to flow to the light emitting element, and the control means controls a potential of the other end of the capacitive element to control a potential of the gate of the field effect transistor of the insulated gate type which forms the second active element to extinguish the light emitting element.

The control means may otherwise control a lighting point of time and an extinguishing point of time of the light emitting element included in each of the pixels at least in a unit of a scanning line within one scanning cycle after the brightness information is written into the pixel.

The image display apparatus may be constructed otherwise such that pixels for red, green and blue are connected commonly to each of the scanning lines, and the control means extinguishes the light emitting elements included in the pixels for red, green and blue at different points of time from one another.

Preferably, the light emitting element is an organic electroluminescence element.

According to a second aspect of the present invention, there is provided an image display apparatus wherein a plurality of pixels are lit in response to brightness information within a period of one scanning cycle after first brightness information is written into the pixels until new second brightness information is written into the pixels, comprising a plurality of scanning lines for individually selecting the pixels in a predetermined scanning cycle, a plurality of data lines formed perpendicularly to the scanning lines for providing brightness information for lighting the pixels, a first active element controlled by each of the scanning lines for fetching the brightness information into each of the pixels, a second active element for converting the brightness information fetched by the first active element into an electric signal to be used to drive the pixel, and control means for placing the pixels from a lit state into an extinguished state within the period of one scanning cycle.

Preferably, the control means is capable of varying a time after the pixels are lit until the pixels are extinguished within the period of one scanning cycle.

The image display apparatus may be constructed such that the second active element is a field effect transistor of the insulated gate type, and the control means includes a third active element connected to a gate of the field effect transistor of the insulated gate type and controlled over a control line which is provided substantially in parallel to each of the scanning lines.

The control means may include a third active element provided in series to the second active element and controlled over a control line which is provided substantially in parallel to each of the scanning lines.

The image display apparatus may be constructed otherwise such that each of the pixels includes a light emitting element having a first terminal connected to the second active element and a second terminal connected to a reference potential, and the control means variably controls the reference potential to extinguish the light emitting element.

The control means may select, after the scanning lines are selected, the scanning lines again within the period of one scanning cycle and supply the brightness information which represents brightness of zero from the data lines to the pixels to extinguish the pixels.

The image display apparatus may be constructed otherwise such that each of the pixels includes a capacitive element having an end connected to a gate of a field effect transistor of the insulated gate type which forms the second active element, and the control means controls a potential of the other end of the capacitive element to control a potential of the gate of the field effect transistor of the insulated gate type which forms the second active element to extinguish the pixels.

The control means may extinguish the pixels for each of the scanning lines.

The image display apparatus may be constructed otherwise such that each of the pixels includes light emitting elements for blue, green and red, and the control means is capable of extinguishing the light emitting elements for blue, green and red at different times from one another.

The image display apparatus may be constructed further otherwise such that the second active element converts the brightness information into current to be used for driving of the pixels, and each of the pixels includes a light emitting element which makes use of an organic substance which emits light with current.

The image display apparatus may be constructed otherwise such that it further comprises a scanning line drive circuit to which a vertical clock signal for successively selecting the scanning lines is inputted, and that the control means includes a control circuit for receiving another vertical clock signal obtained by delaying the vertical clock signal by a predetermined period to select the scanning lines or control lines provided in parallel to the scanning lines, and the scanning lines are successively selected in synchronism with the vertical clock signal by the scanning line drive circuit to light the pixels, the pixels which have been lit being extinguished over the scanning line or the control lines within the period of one scanning cycle in synchronism with the delayed vertical clock signal by the control circuit. In this instance, the image display apparatus may be constructed further such that it further comprises a data line drive circuit for providing the brightness information to the data lines, and that each of outputs of the scanning line drive circuit is connected to an input terminal of a logical OR circuit having an output terminal connected to one of the scanning lines while each of outputs of the control circuits is connected an input terminal of a logical AND circuit connected to the other input terminal of the logical OR circuit, and the vertical clock signal is inputted to the other input terminal of the logical AND circuit.

In the image display apparatus, after brightness information is written into the pixels in a unit of a scanning line, the light emitting elements included in the pixels are extinguished collectively in a unit of a scanning line before brightness information of a next scanning line cycle (frame) is newly written into the pixels. Or in other words, after brightness information is written into each pixel and the pixel begins to emit light, the emission of light can be stopped before writing of a next frame is performed. Consequently, the time from lighting to extinction of the light emitting elements after brightness information is written into the pixels can be adjusted. In other words, the ratio (duty) of the time of light emission within one scanning cycle or one frame can be adjusted. The adjustment of the time of light emission (duty) corresponds to adjustment of the peak current of each light emitting element. Therefore, by adjusting the duty, the display brightness, that is, the display brightness average in time, can be adjusted simply and freely. What is more significant is that the peak current can be increased by setting the duty appropriately. For example, if the duty is reduced to 1/10, then an equal brightness value is obtained even if the peak current is increased to 10 times. If the peak current is increased to 10 times, then the channel length of a thin film transistor included in each pixel can be reduced to 1/10. In this manner, by suitably selecting the duty, the degree of freedom in designing a thin film transistor included in each pixel increases, and this allows practical designing. Further, since the duty can be set freely, a degree of freedom is provided in that the amount of current to flow to each light emitting element upon light emission is set suitably while the display brightness average in time is kept equal. Consequently, a degree of freedom in designing of an active element for controlling the amount of current to flow to the light emitting element is produced. As a result, it becomes possible to design an image display apparatus which can provide an image of a higher degree of picture quality or another image display apparatus of a smaller pixel size.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
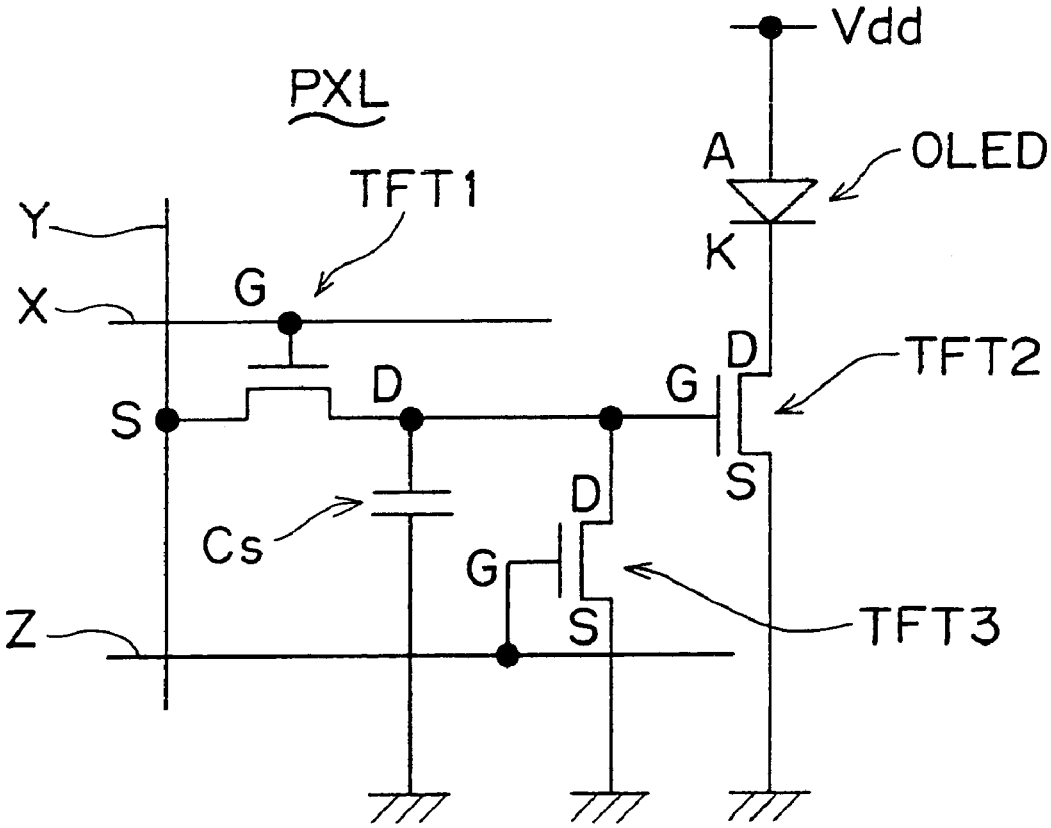
FIG. 1 is a circuit diagram of a pixel of an image display apparatus according to a first embodiment of the present invention.

Referring to FIG. 1, there is shown in an equivalent circuit diagram of a pixel of an image display apparatus according to a first preferred embodiment of the present invention. The image display apparatus includes a plurality of scanning lines X (only one is shown in FIG. 1) for selecting pixels PXL in a predetermined scanning cycle (frame), and a plurality of data lines Y (only one is shown in FIG. 1) for providing brightness information for driving the pixels PXL. The scanning lines X and the data lines Y extend perpendicularly to each other such that such pixels PXL are arranged in a matrix at individual intersecting points thereof. Each of the pixels PXL formed the intersecting points of the scanning lines X and the data lines Y includes a light emitting element OLED, a first thin film transistor TFT1 as a first active element, a second thin film transistor TFT2 as a second active element, and a holding capacitor Cs. The light emitting element OLED emits light with a brightness value which varies depending upon the amount of current supplied thereto. The first active element TFT1 is controlled by the corresponding scanning line X and writes brightness information given thereto from the corresponding data line Y into the holding capacitor Cs included in the pixel PXL. The second thin film transistor TFT2 controls the amount of current to be supplied to the light emitting element OLED in response to the brightness information written in the holding capacitor Cs. The writing of the brightness information into the pixel PXL is performed by applying an electric signal (data potential Vdata) corresponding to the brightness information to the data line Y in a state wherein the scanning line X is selected. The brightness information written in the pixel PXL is held by the holding capacitor Cs also after the scanning line X is placed into a non-selected state, and the light emitting element OLED can be kept in a lit state with a brightness value corresponding to the brightness information held therein. As a characteristic matter of the present invention, the image display apparatus includes control means for compulsorily extinguishing the light emitting elements OLED of those pixels PXL which are connected to the same scanning line X at least in a unit of a scanning line. Thus, within a period of one scanning cycle after brightness information is written into the pixels PXL until new brightness information is written into them again, the light emitting elements are placed into an extinguished state from a lit state. In the present embodiment, the control means includes a third thin film transistor TFT3 (third active element) connected to the gate G of the second thin film transistor TFT2 of each of the pixels PXL such that it is possible to control the gate potential of the second thin film transistor TFT2 with a control signal to be provided to the gate G of the third thin film transistor TFT3 to extinguish the light emitting element OLED. The control signal is applied over a stopping control line Z provided in parallel for each of the scanning lines X to the third thin film transistors TFT3 included in the pixels PXL on the corresponding scanning line. When a third thin film transistor TFT3 is placed into an on state with the control signal, the corresponding holding capacitor Cs discharges and the gate-source voltage Vgs of the second thin film transistor TFT2 becomes 0 V. Consequently, the current to flow to the light emitting element OLED is cut off. The gates G of the third thin film transistors TFT3 of those pixels PXL connected to the same scanning line X are connected commonly to the stopping control line Z which corresponds to the scanning line X so that light emission stopping control can be performed in a unit of a stopping control line Z.

Figure 2:
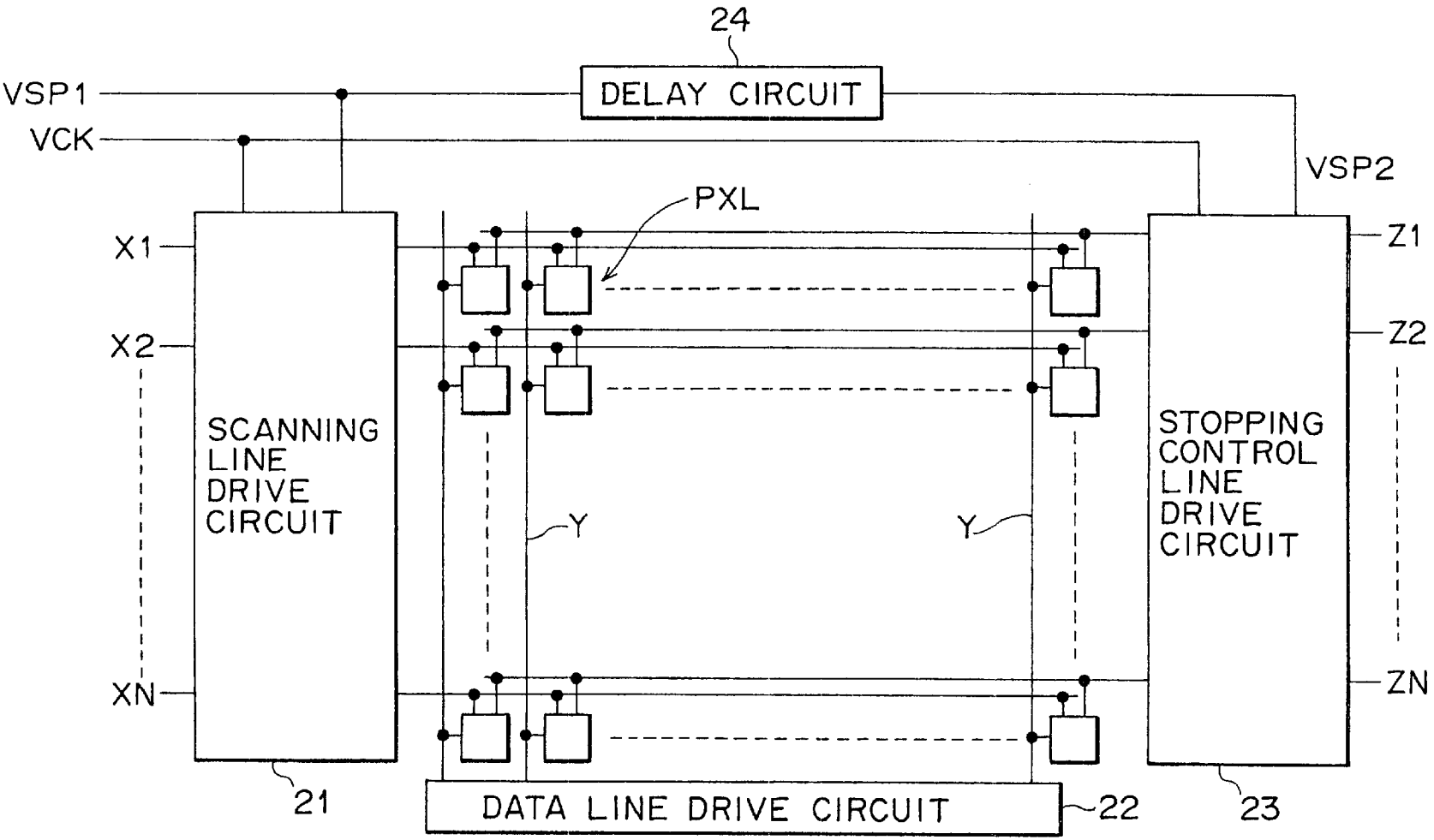
FIG. 2 is a block diagram of the entire circuit of the image display apparatus of the first embodiment of the present invention.

FIG. 2 shows an entire structure of the image display apparatus wherein such pixels PXL as described above with reference to FIG. 1 are arranged in a matrix. Referring to FIG. 2, the scanning lines X1, X2, . . . , XN are arranged in rows, and the data lines Y are arranged in columns. A pixel PXL is formed at each of intersecting points of the scanning lines X and the data lines Y. Further, the stopping control lines Z1, Z2, . . . , ZN are formed in parallel to the scanning lines X1, X2, . . . , XN. The scanning lines X are connected to a scanning line drive circuit 21. The scanning line drive circuit 21 includes a shift register not shown and successively transfers a vertical start pulse VSP1 in synchronism with a vertical clock signal VCK to successively select the scanning lines X1, X2, . . . , XN within one scanning cycle. Meanwhile, the stopping control lines Z are connected to a stopping control line drive circuit 23. Also the stopping control line drive circuit 23 includes a shift register not shown and successively transfers a vertical start pulse VSP2 in synchronism with the vertical clock signal VCK to successively output a control signal to the stopping control lines Z. It is to be noted that the vertical start pulse VSP2 is formed by delaying the vertical start pulse VSP1 by a predetermined time by means of a delay circuit 24. The data lines Y are connected to a data line drive circuit 22, which successively outputs an electric signal corresponding to brightness information to the data lines Y in synchronism with line sequential scanning of the scanning lines X. In this instance, the data line drive circuit 22 performs line sequential scanning to supply an electric signal at a time to a selected row of pixels. Alternatively, the data line drive circuit 22 may perform point sequential driving to successively supply an electric signal to pixels of a selected row. Anyway, the image display apparatus involves both of line sequential driving and point sequential driving.

Figure 3:
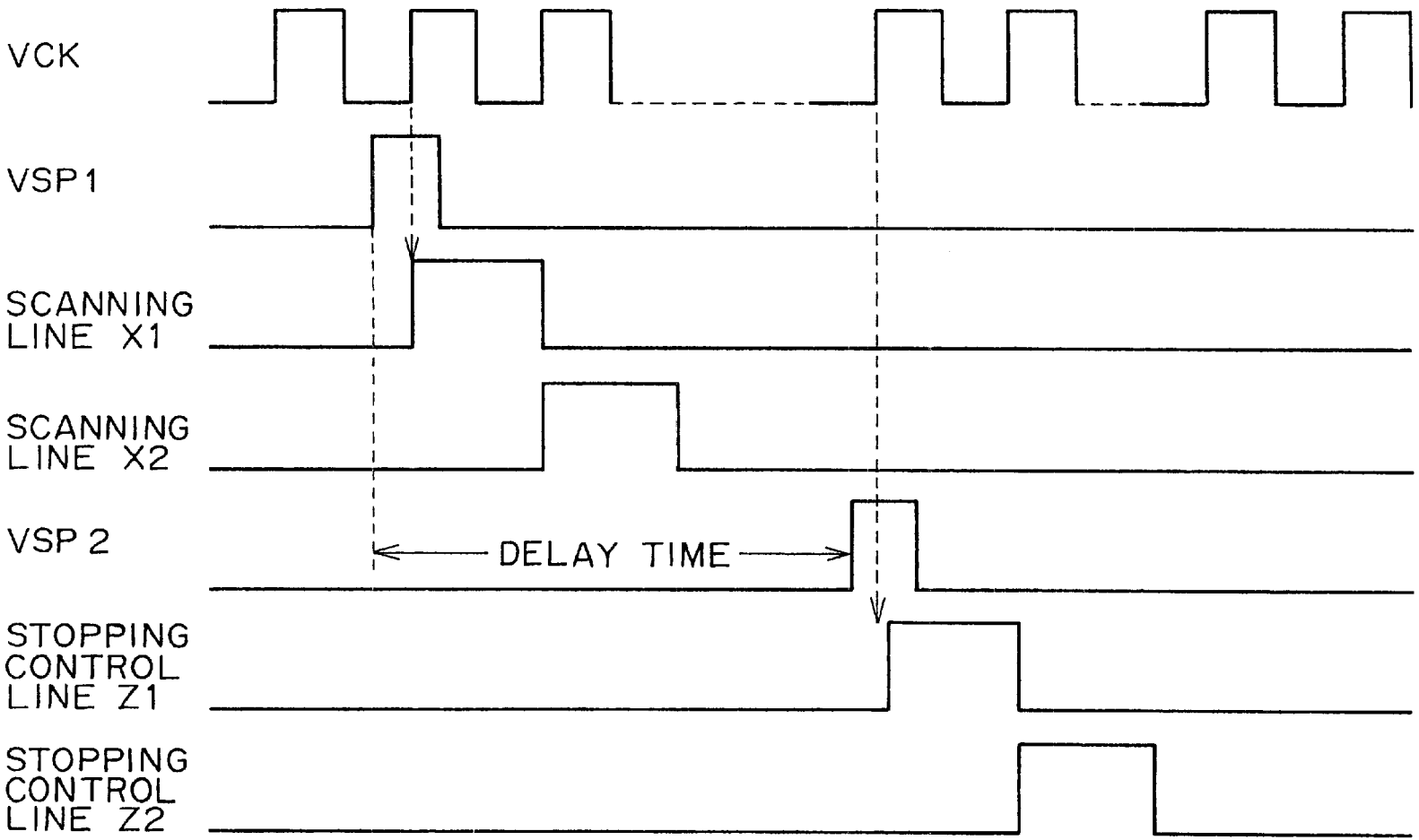
FIG. 3 is a timing chart illustrating operation of the image display apparatus of FIG. 2.

FIG. 3 illustrates operation of the image display apparatus described above with reference to FIGS. 1 and 2. Referring to FIG. 3, a vertical start pulse VSP1 is first inputted to the scanning line drive circuit 21 and the delay circuit 24. After the scanning line drive circuit 21 receives the vertical start pulse VSP1 inputted thereto, it successively selects the scanning lines X1, X2, . . . , XN in synchronism with the vertical clock signal VCK so that brightness information is successively written into the pixels PXL in a unit of a scanning line. Each of the pixels PXL starts emission of light with a level of intensity corresponding to the brightness information written therein. The vertical start pulse VSP1 is delayed by the delay circuit 24 and inputted as the vertical start pulse VSP2 to the stopping control line drive circuit 23. After the stopping control line drive circuit 23 receives the vertical start pulse VSP2, it successively selects the stopping control lines Z1, Z2, . . . , ZN in synchronism with the vertical clock signal VCK so that the emission of light is successively stopped in a unit of a scanning line.

With the image display apparatus described above with reference to FIGS. 1 to 3, each of the pixels PXL emits light within a period after brightness information is written into it until the emission of light is stopped in response to the light emission stopping control signal, that is, substantially within the delay time set by the delay circuit 24. Where the delay time is represented by $\tau$ and the time of one scanning cycle (one frame) is represented by T, then the ratio of the time within which a pixel emits light, that is, the duty, is substantially equal to $\tau/T$. The average brightness in time of the light emitting element increases in proportion to the duty. Accordingly, by operating the delay circuit 24 to vary the delay time $\tau$, the screen brightness of the EL display apparatus can be variably adjusted simply over a wide range.

Further, to facilitate the control of the brightness increases the degree of freedom in designing of a pixel circuit and allows better designing. In the pixel design example of the conventional image display apparatus described hereinabove with reference to FIG. 10, the size of the second thin film transistor TFT2 is decided in the following manner.

Channel width: $W = 5\ \mu m$

Channel length: $L = \{W/(2 \cdot Ip)\} \cdot \mu \cdot Cox \cdot Vp^2$
$= 270\ \mu m$ The dimensions of the second thin film transistor TFT2 correspond to those where the duty of the light emitting element is 1. In contrast, with the image display apparatus described above with reference to FIGS. 1 to 3, the duty can be set to a desired value in advance as described above. For example, it is possible to set the duty to 0.1. In this instance, as a design example according to the present invention, the size of the second thin film transistor TFT2 shown in FIG. 1 can be reduced as given below:

Channel width: W=5 $\mu$m

Channel length: L=270 $\mu$m×0.1=27 $\mu$m

Figure 10:
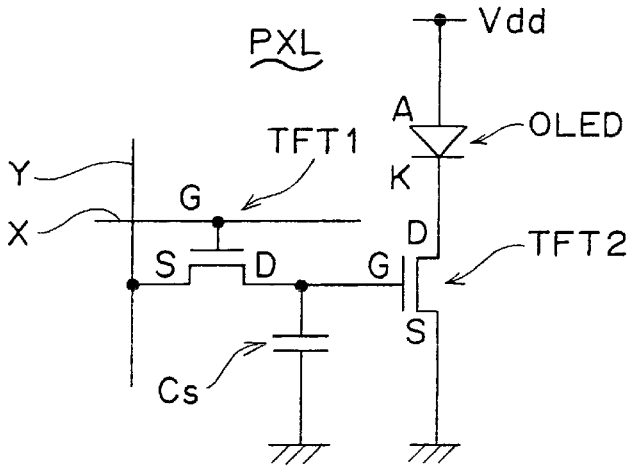
FIG.10 PRIOR ART
FIG. 10 is a circuit diagram of a pixel of an example of a conventional image display apparatus.
Figure 11:
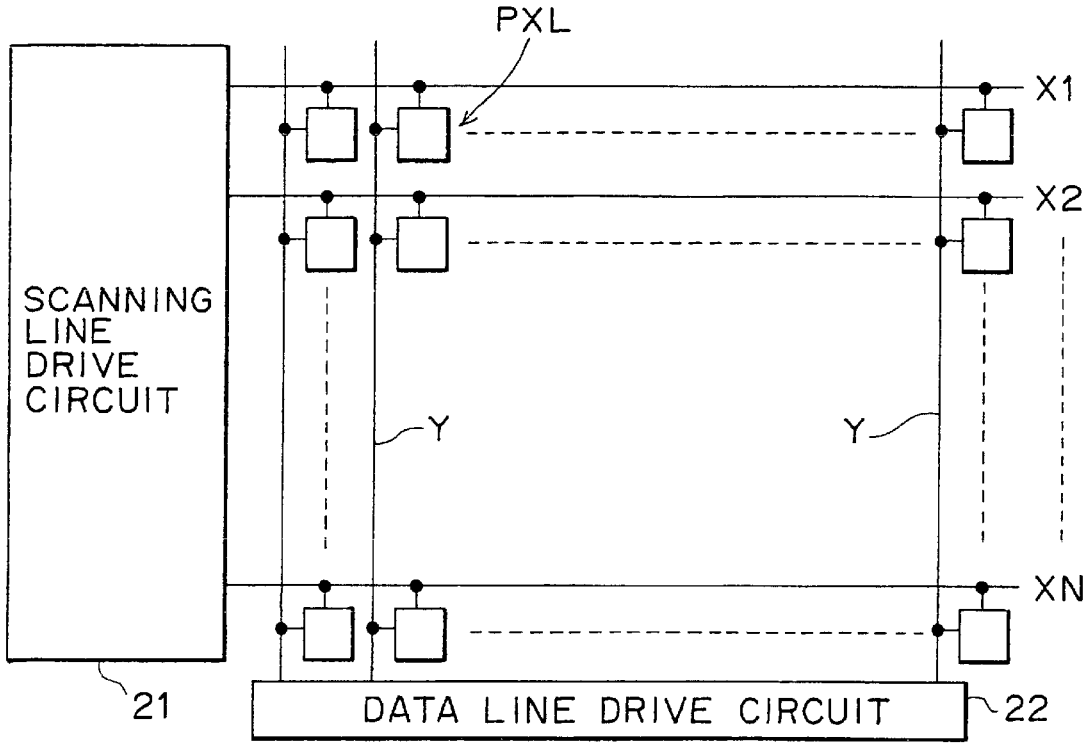
FIG.11 PRIOR ART
FIG. 11 is a block diagram of an entire circuit of the conventional image display apparatus which employs the pixel of FIG. 10.
Figure 12:
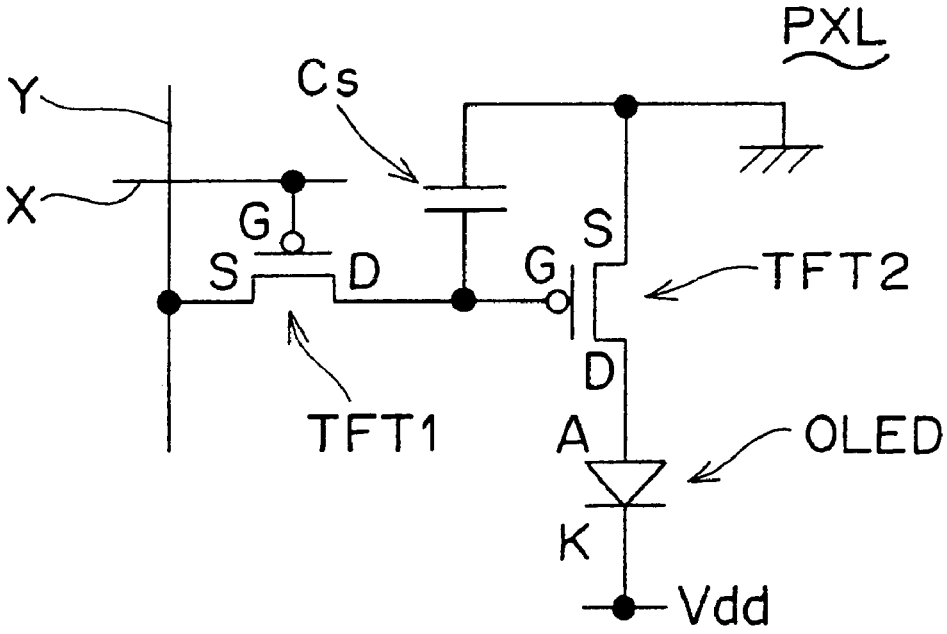
FIG.12 PRIOR ART
FIG. 12 is a circuit diagram of a pixel of another example of a conventional image display apparatus.
Figure 13:
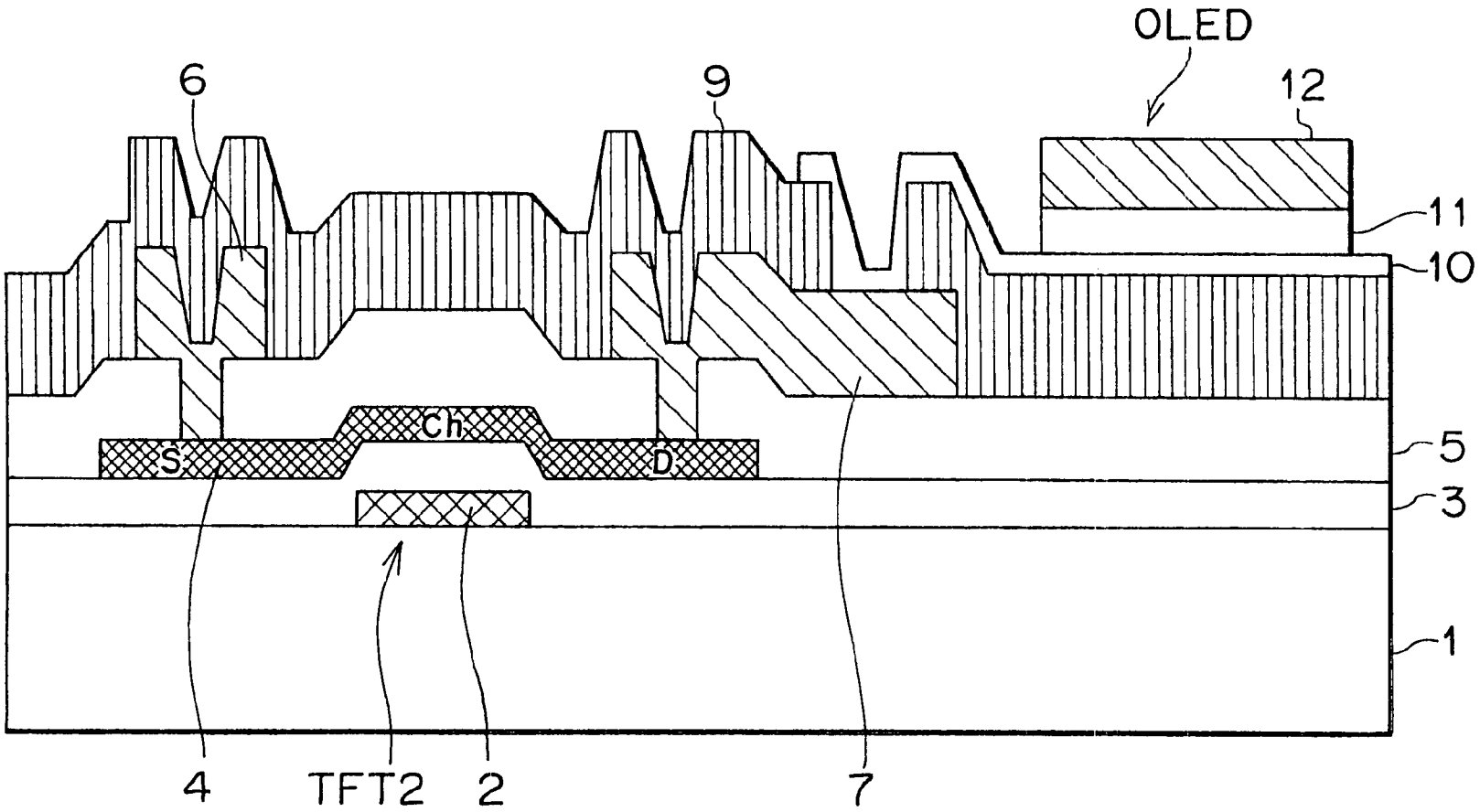
FIG.13 PRIOR ART
FIG. 13 is a sectional view showing a structure of the pixel of FIG. 12.

The other parameters are equal to those of the conventional image display apparatus described hereinabove with reference to FIG. 10. In this instance, the current to flow through the light emitting element OLED upon light emission increases to 10 times in accordance with the expression (1). However, since the duty is set to 0.1, the driving current average in time is equal to that of the conventional image display apparatus. Since, in an organic EL element, the current and the brightness normally have a proportional relationship to each other, the brightness of emitted light average in time is equal between the conventional image display apparatus and the image display apparatus described above with reference to FIGS. 1 to 3. On the other hand, in the design example of the image display apparatus of FIGS. 1 to 3, the channel length L of the second thin film transistor TFT2 is reduced significantly to 1/10 that of the conventional image display apparatus. Consequently, the occupation of the second thin film transistor TFT2 in the inside of the pixel decreases significantly. As a result, a larger occupied area (light emission area) can be assured for the organic EL element, and consequently, the image quality is augmented. Also refinement of a pixel can be realized readily.

Figure 4:
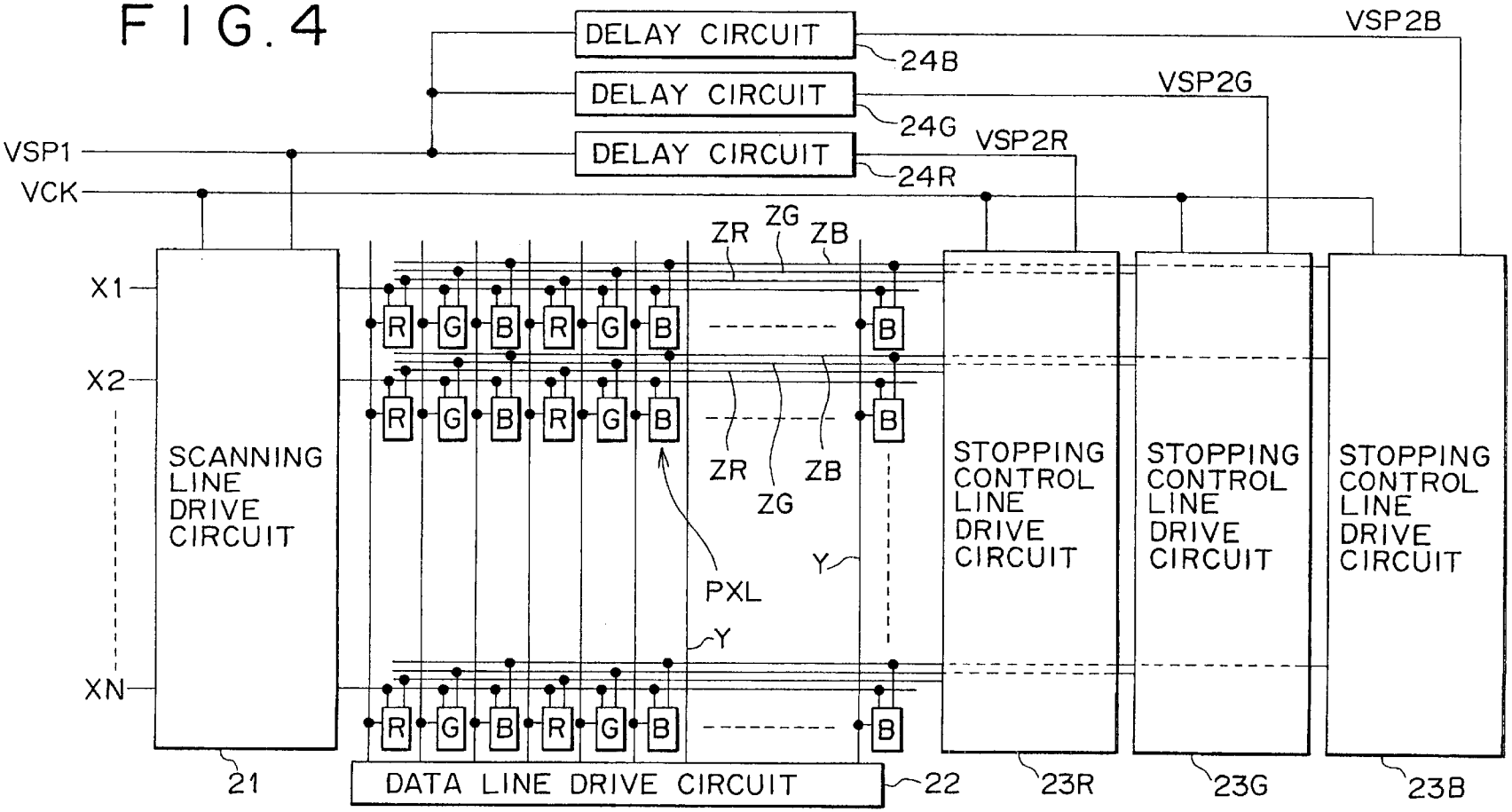
FIG. 4 is a block diagram of an entire circuit of an image display apparatus according to a second embodiment of the present invention.

FIG. 4 is a block diagram of an entire circuit of an image display apparatus according to a second preferred embodiment of the present invention. While the image display apparatus of the first embodiment described above specifically with reference to FIG. 2 is formed as a monochrome image display apparatus, the image display apparatus of the present embodiment is formed as a color image display apparatus wherein pixels PXL to which the three primary colors of R, G and B are allocated are formed in an integrated form. In the image display apparatus of the present embodiment, pixels PXL for red, green and blue are connected commonly to the same scanning line X while the pixels for red, green and blue are connected separately to stopping control lines ZR, ZG and ZB, respectively. Consequently, light emitting elements included in each set of pixels for red, green and blue can be extinguished at separate points of time. More particularly, three stopping control line drive circuits 23R, 23G and 23B are provided separately corresponding to the pixels PXL for the three colors of R, G and B, respectively. Further, delay circuits 24R, 24G and 24B are provided separately corresponding to the stopping control line drive circuits 23R, 23G and 23B, respectively. Accordingly, the delay time of the vertical start pulse VSP1 can be set separately for the primary colors of R, G and B, and vertical start pulses VSP2R, VSP2G and VSP2B can be supplied to the corresponding stopping control line drive circuits 23R, 23G and 23B, respectively. The red pixels (R) are connected to stopping control lines ZR which are controlled by the stopping control line drive circuit 23R; the green pixels (G) are connected to stopping control lines ZG which are controlled by the stopping control line drive circuit 23G; and the blue pixels (B) are connected to stopping control lines ZB which are controlled by the stopping control line drive circuit 23B. With the image display apparatus of the construction described, the brightness can be adjusted for each of the colors of R, G and B. Accordingly, by suitably adjusting the delay times of the delay circuits 24R, 24G and 24B, the chromaticity adjustment of the color image display apparatus can be performed readily and a color balance can be established simply. In particular, where observation of the screen reveals that a red component is excessively strong, the delay time of the delay circuit 24R can be adjusted to relatively decrease the duty corresponding to the red color to weaken the red component.

Figure 5:
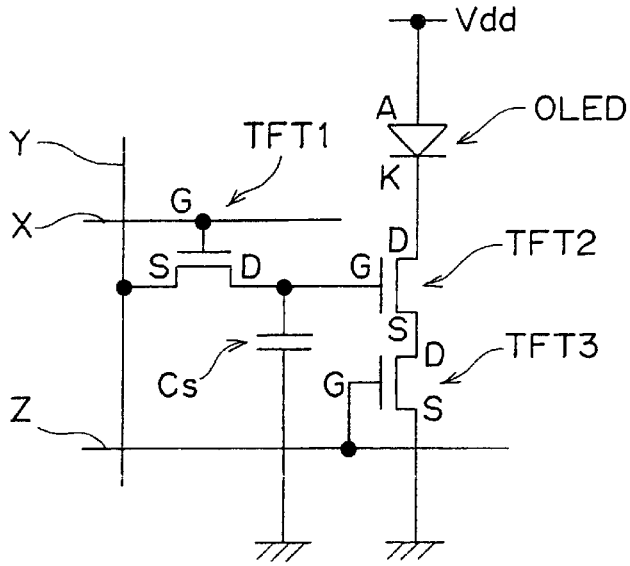
FIG. 5 is a block diagram of a pixel of an image display apparatus according to a third embodiment of the present invention.

FIG. 5 is an equivalent circuit diagram of an image display apparatus according to a third preferred embodiment of the present invention. Referring to FIG. 5, the pixel shown is a modification to but is different from the pixel described hereinabove with reference to FIG. 1 in that the third thin film transistor TFT3 serving as a third active element is connected in series to the light emitting element OLED. Consequently, the current to flow to the light emitting element OLED can be cut off in accordance with a control signal applied to the third thin film transistor TFT3. The control signal is provided to the gate G of the third thin film transistor TFT3 included in each of pixels on the same scanning line over a stopping control line Z provided in parallel to each of the scanning line X. In the pixel of FIG. 5, the third thin film transistor TFT3 is inserted between the ground potential and the second thin film transistor TFT2 so that the current to flow to the light emitting element OLED can be tuned on/off by control of the gate potential to the third thin film transistor TFT3. It is to be noted that the third thin film transistor TFT3 may otherwise be inserted between the second thin film transistor TFT2 and the light emitting element OLED or between the light emitting element OLED and a power supply potential Vdd.

Figure 6:
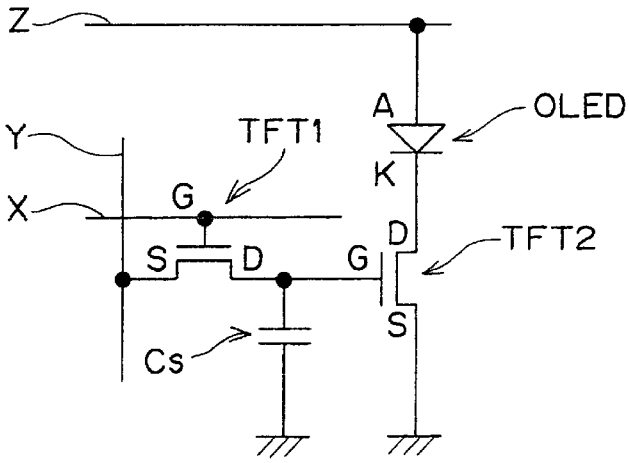
FIG. 6 is a block diagram of a pixel of an image display apparatus according to a fourth embodiment of the present invention.

FIG. 6 is an equivalent circuit diagram of an image display apparatus according to a fourth preferred embodiment of the present invention. Referring to FIG. 6, the pixel shown is an improvement to but is different from the conventional pixel described hereinabove with reference to FIG. 10 in that the light emitting element OLED is in the form of a two-terminal element having a rectification function. One (the cathode K) of the two terminals of the light emitting element OLED is connected to the second thin film transistor TFT2, and the other terminal (anode A) is connected to a stopping control line Z. The anodes A of the two-terminal elements of those pixels which are on the same scanning line are connected commonly to a stopping control line Z, and the anodes A of the two-terminal elements of the pixels on different scanning lines are electrically isolated from each other. In th is instance, the potentials of the terminals (anodes A) of the two-terminal elements which are connected commonly a re controlled by the stopping control line Z to extinguish the light emitting elements OLED of the pixels. However, the anode A of each of the light emitting elements OLED is not connected to the power supply potential Vdd of a fixed potential as in the conventional image display apparatus, but the potential thereof is controlled from the outside over the stopping control line Z. If the anode potential has a sufficiently high value, then current which is controlled by the second thin film transistor TFT2 flows to the light emitting element OLED. However, since the light emitting element OLED is a two-terminal element and has a rectification function, by setting the anode potential to a sufficiently low level (for example, the ground potential), the current to flow to the light emitting element OLED can be turned off.

Figure 7:
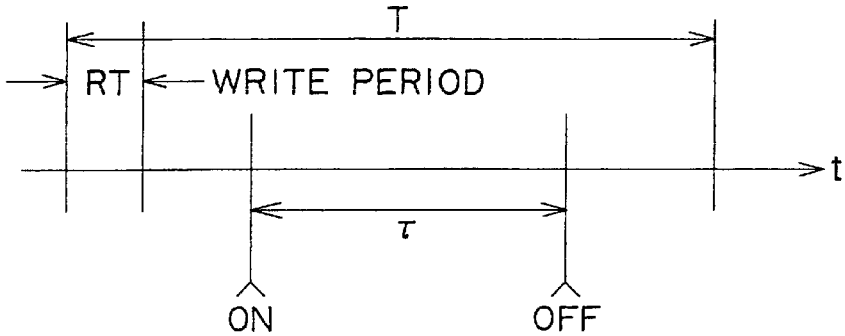
FIG. 7 is a timing chart illustrating operation of the pixel of FIG. 6.

FIG. 7 illustrates an example of control of the pixel shown in FIG. 6. Referring to FIG. 7, one scanning cycle (one frame) is represented by T. Within a write period (RT) positioned at the top of the one scanning cycle T, writing of brightness information into all pixels is performed line sequentially. In particular, in the operation illustrated in FIG. 7, brightness information is written at a high speed into all pixels making use of part of one scanning cycle. After the writing is completed, the stopping control lines Z are controlled at a time to turn on the light emitting elements OLED included in the pixels. Consequently, the light emitting element OLED of each pixel starts emission of light in response to the brightness information written therein. Then, after a predetermined delay time $\tau$ elapses, the anodes A of all of the light emitting elements OLED are controlled to the ground potential over all of the stopping control lines Z. Consequently, the emission of light stops. By the control described, the duty τ/T can be adjusted in all pixel units. However, on/off switching of the individual pixels may be controlled otherwise at least in a unit of a scanning line. As described above, in the pixel shown in FIG. 6, within one scanning cycle after brightness information is written into the pixels, the lighting point of time and the extinguishing point of time of the light emitting element included in each pixel can be controlled in a unit of a screen or in a unit of a scanning line.

Figure 8:
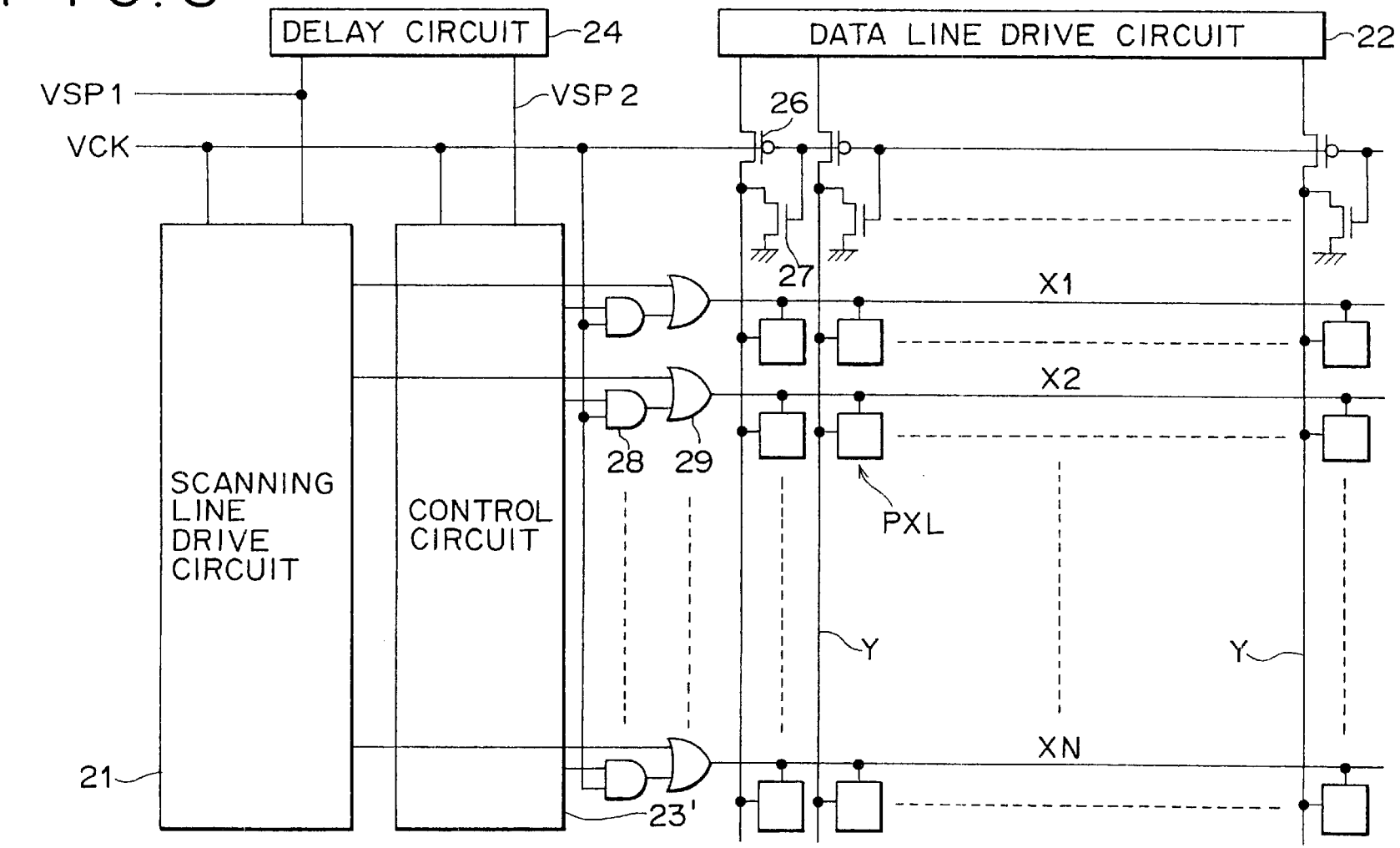
FIG. 8 is a block diagram of an entire circuit of an image display apparatus according to a fifth embodiment of the present invention.

FIG. 8 is a block diagram of an entire circuit of an image display apparatus according to a fifth embodiment of the present invention. Referring to FIG. 8, the image display apparatus of the present embodiment is a modification to but is different from the image display apparatus described hereinabove with reference to FIG. 2 principally in that no special stopping control line is provided, but duty control of the pixels PXL is performed making use of the scanning lines X1 to XN. To this end, in place of the stopping control line drive circuit 23, a control circuit 23' is provided separately from the scanning line drive circuit 21. Each of output terminals of the control circuit 23' is connected to one of a pair of input terminals of a corresponding one of AND gate circuits 28. The output terminal of each of the AND gate circuits 28 is connected to a corresponding one of the scanning lines X1, X2, . . . , XN through one of a pair of input terminals of a corresponding one of OR gate circuits 29 in the next stage. The vertical clock signal VCK is supplied to the other input terminal of each of the AND gate circuits 28. It is to be noted that each of the output terminals of the scanning line drive circuit 21 is connected to a corresponding one of the scanning lines X1, X2, . . . , XN through the other input terminal of a corresponding one of the OR gate circuits 29. The vertical start pulse VSP1 is converted into the vertical start pulse VSP2 by the delay circuit 24 similarly as in the image display apparatus of FIG. 2 and supplied to the control circuit 23'. Meanwhile, the data lines Y are connected to the data line drive circuit 22 through P-channel TFTs 26. The vertical clock signal VCK is supplied to the gates of the TFTs 26. Further, the potential of each of the data lines Y can be controlled by an N-channel TFT 27. The vertical clock signal VCK is supplied also to the gates of the TFTs 27. In this manner, while the construction of the peripheral circuit of the image display apparatus is different from that of the conventional image display apparatus described hereinabove with reference to FIG. 10, the circuit construction of each of the pixels PXL is same as that of the conventional image display apparatus shown in FIG. 10. Due to the construction described, within one scanning cycle within which new brightness information is written after brightness information is written into each pixel PXL, the control circuit 23' can select the scanning lines X again and write information representative of the brightness of 0 from the data lines Y into the individual pixels PXL to extinguish the light emitting elements OLED of the pixels PXL.

Figure 9:
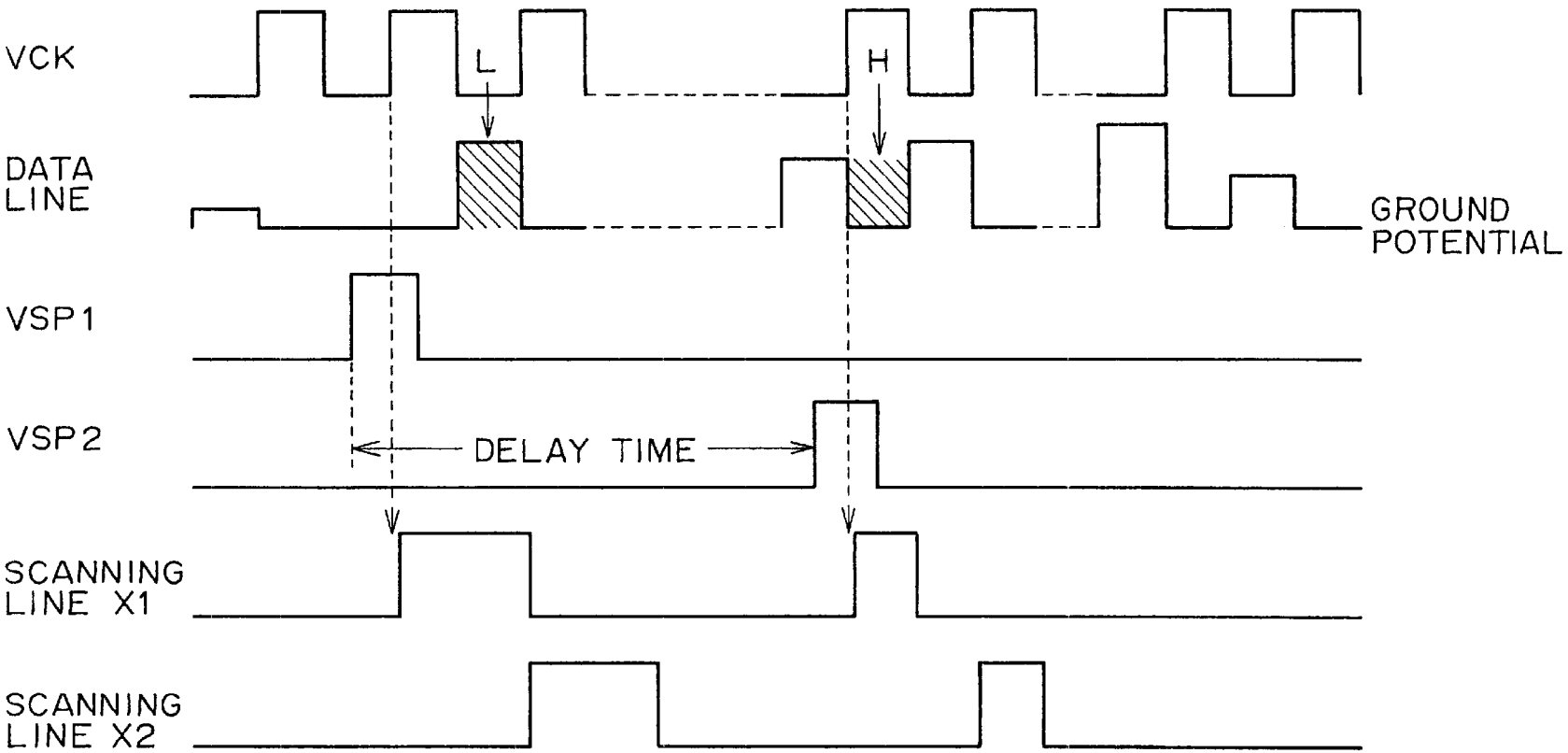
FIG. 9 is a timing chart illustrating operation of the image display apparatus of FIG. 8.

FIG. 9 illustrates operation of the image display apparatus described above with reference to FIG. 8. Referring to FIGS. 8 and 9, a vertical start pulse VSP1 is inputted to the scanning line drive circuit 21 and the delay circuit 24. After the vertical start pulse VSP1 is received, the scanning line drive circuit 21 successively selects the scanning lines X1, X2, . . . , XN in synchronism with the vertical clock signal VCK to write brightness information in the pixels PXL in a unit of a scanning line. Each of the pixels begins to emit light with a value of intensity corresponding to the brightness information written therein. In the image display apparatus of the present embodiment, however, since the TFTs 26 and 27 are provided, each data line Y has a potential (in the present example, the ground potential) corresponding to the brightness of 0 within a period within which the vertical clock signal VCK is VCK=H (high level), but within a period within which the vertical clock signal is VCK=L (low level), original brightness information is provided. This relationship is schematically represented by applying the characters L and H to the waveform of the vertical clock signal VCK of FIG. 9 and applying slanting lines to the waveform of the data line. The vertical start pulse VSP1 is delayed by the delay circuit 24 and inputted as the vertical start pulse VSP2 to the control circuit 23'. After the vertical start pulse VSP2 is received, the control circuit 23' operates in synchronism with the vertical clock signal VCK, and the outputs of the control circuit 23' are inputted to the AND gate circuits 28. Since the vertical clock signal VCK is inputted simultaneously to the AND gate circuits 28, a scanning line X is selected when the corresponding output of the control circuit 23' is H (high level) and the vertical clock signal VCK is VCK=H (high level). Since the potential corresponding to the brightness of 0 is given to the data lines Y within a period within which VCK=H as described above, the pixels connected to a scanning line X selected by the control circuit 23' stop the emission of light with the information corresponding to the.brightness of 0.

Figure 14:
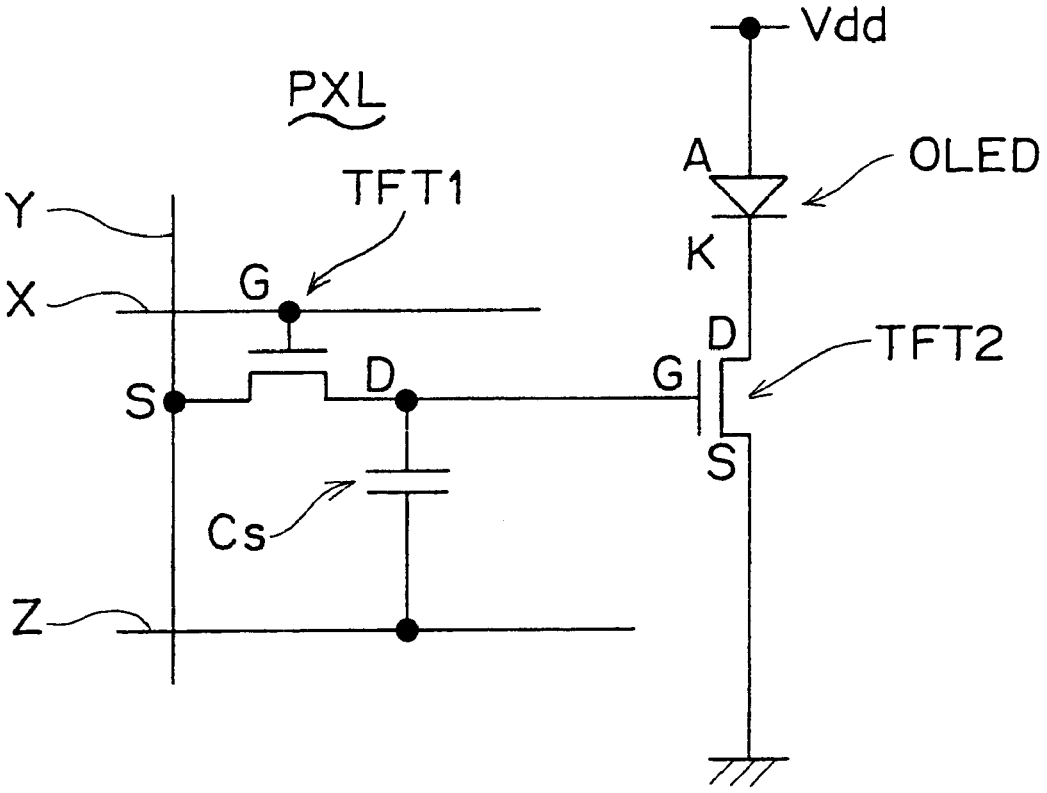
FIG. 14 is an equivalent circuit diagram of a pixel of an image display apparatus according to a sixth embodiment of the present invention.

FIG. 14 is an equivalent circuit diagram of a pixel of an image display apparatus according to a sixth embodiment of the present invention. In the pixels in the embodiments described above, it is necessary to add a transistor for allowing extinction of the pixel. However, the pixel in the present embodiment does not require an additional transistor and consequently has a more practical construction. As seen from FIG. 14, a holding capacitor Cs is connect to the gate G of a second thin film transistor TFT2 for controlling the amount of current to be supplied to a light emitting element OLED, and the other terminal of the holding capacitor Cs is connected to a stopping control line Z. After writing is completed, the potential of the stopping control line Z is lowered in the circuit construction of FIG. 14. For example, where the capacitance of the holding capacitor Cs is sufficiently higher than the gate capacitance of the second thin film transistor TFT2 and so forth, a potential variation of the stopping control line Z causes a variation of the gate potential of the second thin film transistor TFT2. Accordingly, where the maximum value of the gate potential of the second thin film transistor TFT2 upon writing is represented by Vgmax, by lowering the potential of the stopping control line Z by more than Vgmax−Vth when compared with that upon writing, the gate potential of the second thin film transistor TFT2 can be controlled to a level lower than the threshold voltage Vth. Accordingly, the light emitting element OLED becomes extinguished. Actually, it is preferable to control with a rather great amplitude taking the gate capacitance of the second thin film transistor TFT2 and so forth into consideration.

Figure 15:
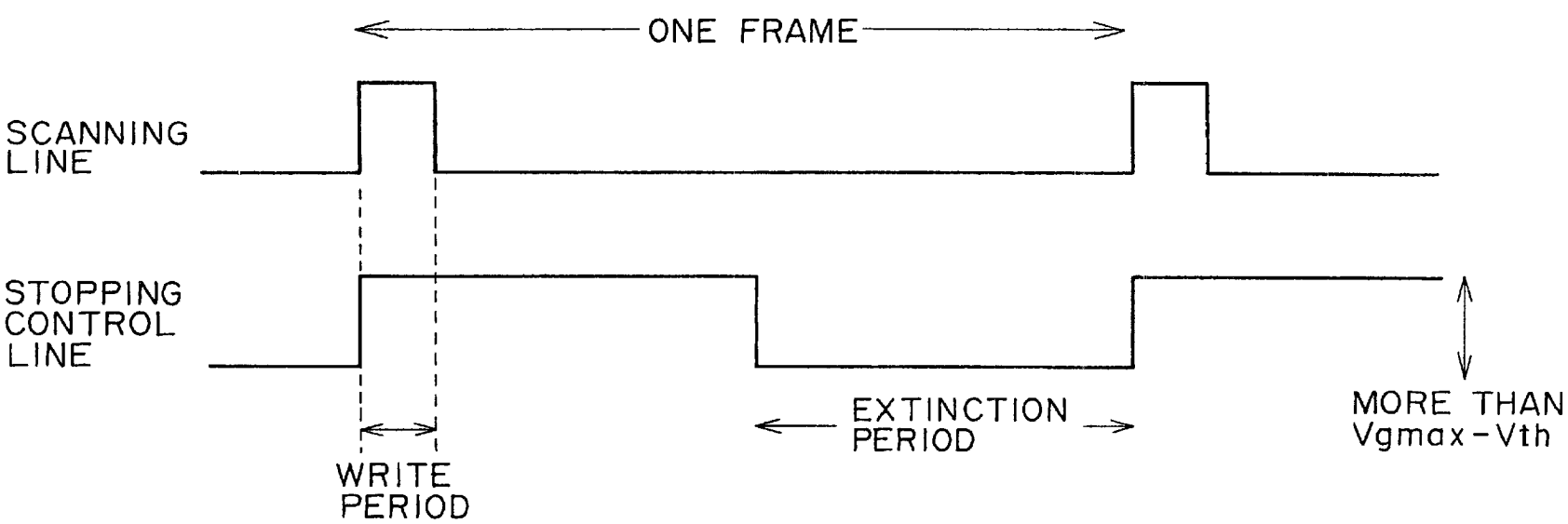
FIG. 15 is a timing chart illustrating operation of the pixel of FIG. 14.

FIG. 15 illustrates operation of the pixel described above with reference to FIG. 14. Referring to FIGS. 14 and 15, the stopping control line Z is controlled to the high level substantially simultaneously with scanning line selection, and within a period within which the high level is kept after writing is completed, the light emitting element remains in a light emitting state with a brightness level corresponding to the brightness information written therein. The light emitting element is extinguished when the stopping control line Z is controlled to the low level before new data for a next frame are written into the pixels PXL.

By the way, while the brightness of a display image of a CRT (cathode ray tube) attenuates in the order of μsec, a display apparatus of the active matrix type uses a display principle of the held type wherein an image continues to be displayed for a period of one frame. Therefore, when a moving picture is to be displayed, pixels along a contour of the moving picture continue to display the image till the time immediately before changeover of the frame. This is effective, together with an after-image effect of the eyes of the human being, to cause a person who observes the image to feel as if the image was displayed there also in the next frame. This is a fundamental cause in that the picture quality of a moving picture display on a display apparatus of the active matrix type is lower than that of a CRT. As a countermeasure to this problem, it is effective to use the driving method according to the present invention, and by introducing a technique of compulsorily extinguishing pixels to cut off an after-image felt by the eyes of the human being, augmentation of the picture quality of a moving picture can be achieved. More particularly, the present invention adopts a method wherein, in a display apparatus of an active matrix type, an image is displayed in the former half of one frame, and in the latter half of the one frame, the image is extinguished as if the brightness of the CRT were attenuated. For augmentation of the picture quality of a moving picture, the duty of lighting with respect to extinction per one frame is set to approximately 50%. For further augmentation of the picture quality of a moving picture, the duty of lighting with respect to extinction per one frame should be set to 25% or less.

While preferred embodiments of the present invention have been described using specific terms, such description is for illustrative purposes only, and it is to be understood that changes and variations may be made without departing from the spirit or scope of the following claims.

What is claimed is:

1. An image display apparatus, comprising:

a plurality of pixels arranged in a matrix;

a plurality of scanning lines for selecting said pixels in a predetermined scanning cycle;

a plurality of data lines extending perpendicularly to said scanning lines for providing brightness information to drive said pixels;

said pixels being disposed at intersecting points of said scanning lines and said data lines;

each of said pixels including a light emitting element for emitting light with a brightness value which varies depending upon an amount of current supplied thereto, a first active element controlled by one of said scanning lines for writing the brightness information given thereto from one of said data lines into the pixel connected to said data line while the scanning line connected to said pixel is selected, a second active element for controlling the amount of current to be supplied to the light emitting element in response to the brightness information written in the pixel;

and means for holding the brightness information written in each of said pixels also after the scanning line connected to the pixel is placed into a non-selected state so that the light emitting element of the pixel can continue lighting with a brightness value corresponding to the brightness information held by the pixel characterized in that it further comprises control means for compulsorily extinguishing the light emitting elements of those of said pixels which are connected to a same one of said scanning lines in at least one scanning line so that the light emitting elements are placed into an extinguished state from a lit state within a period of one scanning cycle corresponding to the period between the writing of the brightness information into said pixels and the writing of new brightness information into said pixels subsequently, thereby controlling temporal average brightness of the light emitting elements.

2. An image display apparatus according to claim 1, wherein said control means is capable of adjusting the time at which each of the light emitting elements is changed over from a lit state to an extinguished state within a period of one scanning cycle.

3. An image display apparatus according to claim 1, wherein said control means includes a third active element connected to a gate of said second active element, which is in the form of a field effect transistor of the insulated gate type, of each of said pixels and is capable of providing a control signal to said third active element to control a gate potential of said second active element thereby to extinguish the light emitting element of the pixel, the control signal being applied to the third active elements included in those of said pixels which are on a same one of said scanning lines over a stopping control line provided for and in parallel to each of said scanning lines.

4. An image display apparatus according to claim 1, wherein said control means includes a third active element connected in series to said light emitting element of each of said pixels and is capable of providing a control signal to said third active element to cut off current to flow to said light emitting element, the control signal being applied to the third active elements included in those of said pixels which are on a same one of said scanning lines over a stopping control line provided for and in parallel to each of said scanning lines.

5. An image display apparatus according to anyone of claims 1 to 4, wherein said light emitting element of each of said pixels includes a two-terminal element having a rectification function and having a first terminal connected to said second active element and a second terminal connected to the second terminals of those of said pixels which are connected to a same one of said scanning lines to which the pixel is connected but electrically isolated from the second terminals of those of said pixels which are connected to any other one of said scanning lines, and said control means controls a potential of the second terminals of the two-terminal elements which are connected commonly to the same scanning line to extinguish the two-terminal elements.

6. An image display apparatus according to anyone of claims 1 to 4, wherein said control means selects, within a period of one scanning cycle, said scanning lines again to write information representative of brightness of zero into said pixels from said data lines to extinguish the light emitting elements of said pixels.

7. An image display apparatus according to anyone of claims 1 to 4, wherein each of said pixels further includes a capacitive element having an end connected to a gate of a field effect transistor of the insulated gate type which forms said second active element for controlling the amount of current to flow to said light emitting element, and said control means controls a potential of the other end of said capacitive element to control a potential of the gate of said field effect transistor of the insulated gate type which forms said second active element to extinguish the light emitting element.

8. An image display apparatus according to anyone of claims 1 to 4, wherein said control means controls the lighting time and the extinguishing time of said light emitting element included in each of said pixels at least in one scanning line within one scanning cycle after the brightness information is written into the pixel.

9. An image display apparatus according to anyone of claims 1 to 4, wherein said control means extinguishes said pixels for each of said scanning lines.

10. An image display apparatus according to anyone of claims 1 to 4, wherein said pixels include pixels for red, green and blue which are connected commonly to each of said scanning lines, and said control means extinguishes the light emitting elements included in the pixels for red, green and blue at different times from one another.

11. An image display apparatus according to anyone of claims 1 to 4, wherein said light emitting element is an organic electroluminescence element.

12. An image display apparatus according to any one of claims 1 to 4, further comprising a scanning line drive circuit to which a first vertical start pulse in synchronism with a vertical clock signal for successively selecting said scanning lines is inputted, and wherein said control means includes a control circuit for receiving a second vertical start pulse in synchronism with the vertical clock signal obtained by delaying the first vertical start pulse by a predetermined period to select the control lines provided in parallel to said scanning lines, said scanning lines are successively selected in synchronism with the vertical clock signal by said scanning line drive circuit to light said pixels, and said pixels which have been lit are extinguished through said control lines within the period of one scanning cycle in synchronism with the vertical clock signal by said control circuit.

13. An image display apparatus according to claim 12, further comprising a data line drive circuit for providing the brightness information to said data lines, and wherein each of outputs of said scanning line drive circuit is connected to an input terminal of a logical OR circuit having an output terminal connected to one of said scanning lines while each of outputs of said control circuits is connected an input terminal of a logical AND circuit connected to the other input terminal of said logical OR circuit, and the vertical clock signal is inputted to the other input terminal of said logical AND circuit.

14. A driving method for an image display apparatus according to anyone of claims 15 to 18, wherein, in the control step, said pixels for each of said scanning lines are extinguished.

15. A driving method for an image display apparatus which includes a plurality of pixels arranged in a matrix, a plurality of scanning lines for selecting said pixels in a predetermined scanning cycle, and a plurality of data lines extending perpendicularly to said scanning lines for providing brightness information to drive said pixels and wherein said pixels are disposed at intersecting points of said scanning lines and said data lines and each of said pixels including a light emitting element for emitting light with a brightness value which varies depending upon an amount of current supplied thereto, a first active element controlled by one of said scanning lines for writing the brightness information given thereto from one of said data lines into the pixel, and a second active element for controlling the amount of current to be supplied to the light emitting element in response to the brightness information written in the pixel, comprising the steps of writing brightness information into each of said pixels by applying an electric signal corresponding to the brightness information to the data line connected to the pixel while the scanning line connected to the pixel is selected, the brightness information written in each of said pixels being held by the pixel also after the scanning line connected to the pixel is placed into a non-selected state so that the light emitting element of the pixel can continue lighting with a brightness value corresponding to the brightness information held by the pixel, characterized in that it further comprises the step of compulsorily extinguishing the light emitting elements of those of said pixels which are connected to a same one of said scanning lines in at least one scanning line so that the light emitting elements are placed into an extinguished state from a lit state within a period of one scanning cycle, corresponding to the period between the writing of the brightness information into said pixels and the writing of new brightness information into said pixels subsequently, thereby controlling temporal average brightness of the light emitting elements.

16. A driving method for an image display apparatus according to claim 15, wherein the time at which each of the light emitting elements is changed over from a lit state to an extinguished state is adjustable within a period of one scanning cycle.

17. A driving method for an image display apparatus according to claim 15, wherein a third active element is connected to a gate of said second active element, which is in the form of a field effect transistor of the insulated gate type, of each of said pixels such that a control signal can be provided to said third active element to control a gate potential of said second active element thereby to extinguish the light emitting element of the pixel, the control signal being applied to the third active elements included in those of said pixels which are on a same one of said scanning lines over a stopping control line provided for and in parallel to each of said scanning lines.

18. A driving method for an image display apparatus according to claim 15, wherein a third active element is connected in series to said light emitting element of each of said pixels such that a control signal can be provided to said third active element to cut off current to flow to said light emitting element, the control signal being applied to the third active elements included in those of said pixels which are on a same one of said scanning lines over a stopping control line provided for and in parallel to each of said scanning lines.

19. A driving method for an image display apparatus according to anyone of claims 11 to 14, wherein said light emitting element of each of said pixels includes a two-terminal element having a rectification function and having a first terminal connected to said second active element and a second terminal connected to the second terminals of those of said pixels which are connected to a same one of said scanning lines to which the pixel is connected but electrically isolated from the second terminals of those of said pixels which are connected to any other one of said scanning lines, a potential of the second terminals of the two-terminal elements which are connected commonly to the same scanning line being controlled to extinguish the two-terminal elements.

20. A driving method for an image display apparatus according to anyone of claims 15 to 18, wherein, within a period of one scanning cycle, said scanning lines are selected again to write information representative of brightness of zero into said pixels from said data lines to extinguish the light emitting elements of said pixels.

21. A driving method for an image display apparatus according to anyone of claims 15 to 18, wherein each of said pixels further includes a capacitive element having an end connected to a gate of a field effect transistor of the insulated gate type which forms said second active element for controlling the amount of current to flow to said light emitting element, and a potential of the other end of said capacitive element is controlled to control a potential of the gate of said field effect transistor of the insulated gate type which forms said second active element to extinguish the light emitting element.

22. A driving method for an image display apparatus according to anyone of claims 15 to 18, wherein a lighting point of time and an extinguishing point of time of said light emitting element included in each of said pixels are controlled at least in a unit of a scanning line within one scanning cycle after the brightness information is written into the pixel.

23. A driving method for an image display apparatus according to anyone of claims 15 to 18, wherein pixels include pixels for red, green and blue are connected commonly to each of said scanning lines, and the light emitting elements included in the pixels for red, green and blue are extinguished at different points of time from one another.

24. A driving method for an image display apparatus according to anyone of claims 15 to 18, wherein said light emitting element is an organic electroluminescence element.

25. A driving method for an image display apparatus according to anyone of claims 15 to 18, further comprising a scanning line drive step of receiving a first vertical start pulse in synchronism with a vertical clock signal for successively selecting said scanning lines, and wherein the control step includes a step of receiving a second start pulse in synchronism with the vertical clock signal, obtained by delaying the first vertical pulse by a predetermined period to select control lines provided in parallel to said scanning lines, said scanning lines are successively selected in synchronism with the vertical clock signal in the scanning line drive step to light said pixels, and said pixels which have been lit are extinguished through said control lines within the period of one scanning cycle in synchronism with the vertical clock signal in the control step.

26. A driving method for an image display apparatus according to claim 25, further comprising a data line drive step of providing the brightness information to said data lines, and wherein each of outputs of said scanning line drive circuit is connected to an input terminal of a logical OR circuit having an output terminal connected to one of said scanning lines while each of outputs in said control step is connected to an input terminal of a logical AND circuit connected to the other input terminal of said logical OR circuit, and the vertical clock signal is inputted to the other input terminal of said logical AND circuit.

* * * * *